US009856694B2

(12) United States Patent
Taniyama

(10) Patent No.: US 9,856,694 B2
(45) Date of Patent: Jan. 2, 2018

(54) WATER-BLOCKING DEVICE

(71) Applicant: YAMAGEN CO., LTD., Osaka (JP)

(72) Inventor: Yuka Taniyama, Osaka (JP)

(73) Assignee: Yamagen Co., Ltd., Osaka (JP)

( * ) Notice: Subject to any disclaimer, the term of this patent is extended or adjusted under 35 U.S.C. 154(b) by 0 days.

(21) Appl. No.: 15/351,841

(22) Filed: Nov. 15, 2016

(65) Prior Publication Data

US 2017/0211313 A1 Jul. 27, 2017

(30) Foreign Application Priority Data

Jan. 26, 2016 (JP) ..... 2016-012267

(51) Int. Cl.
*E06B 3/26* (2006.01)
*E06B 9/00* (2006.01)
(Continued)

(52) U.S. Cl.
CPC ..... *E06B 9/00* (2013.01); *E04F 13/00* (2013.01); *E02D 29/00* (2013.01); *E02D 29/02* (2013.01); *E04B 2/00* (2013.01); *E04F 13/22* (2013.01); *E06B 5/00* (2013.01); *E06B 5/10* (2013.01); *E06B 2009/007* (2013.01)

(58) Field of Classification Search
CPC .. E04F 13/00; E04F 13/22; E06B 5/00; E06B 5/10; E04B 2/00; Y10T 24/3768; E02D 2009/005; E02D 29/00; E02D 29/02; E02D 29/0225; E02D 29/0233; E02D 29/0241; E02D 29/0266; E02D 5/76
USPC ..... 52/745.05, 754.06, 202, 203; 405/284, 405/286, 15, 229, 262; 24/714.6, 712
See application file for complete search history.

(56) References Cited

U.S. PATENT DOCUMENTS 4,514,113 A * 4/1985 Neumann ..... E02D 29/0233 405/262
4,929,125 A * 5/1990 Hilfiker ..... E02D 29/025 405/262

(Continued)

FOREIGN PATENT DOCUMENTS

JP 2001-329759 A 11/2001

*Primary Examiner* — Chi Q Nguyen
(74) *Attorney, Agent, or Firm* — Cesari and McKenna, LLP

(57) ABSTRACT

An object of the present invention is to provide a water-blocking device that can be easily installed in a short time and can surely prevent water intrusion. The water-blocking device 1 includes a water-blocking plate 2, a first band 3 for fixing the water-blocking plate 2 to the installation surface 10, at least one first band passer 5 mounted near an installation location of the water-blocking plate on the installation surface 10, third band passers 7 mounted on left and right walls, etc., 11, 12 defining an entrance or exit S, and second bands 4 for fixing the water-blocking plate 2 to the walls, etc., 11, 12. The water-blocking plate 2 is provided with at least one second band passer 6 and fourth band passers 8. The first band 3 is wound through the first band passer 5 and the second band passer 6 in such a manner that a pressing force toward the installation surface 10 is exerted onto the water-blocking plate 2. The second bands 4 are wound through third band passers 7 and fourth band passers 8 in such a manner that pressing forces toward the walls, etc., 11, 12, are exerted onto the water-blocking plate 2.

12 Claims, 19 Drawing Sheets

(51) Int. Cl.

| | |
|---|---|
| ***E04F 13/00*** | (2006.01) |
| *E02D 29/00* | (2006.01) |
| *E04B 2/00* | (2006.01) |
| *E06B 5/00* | (2006.01) |
| *E04F 13/22* | (2006.01) |
| *E02D 29/02* | (2006.01) |
| *E06B 5/10* | (2006.01) |

(56) References Cited

U.S. PATENT DOCUMENTS

| | | | | |
|---|---|---|---|---|
| 5,451,120 | A * | 9/1995 | Martinez-Gonzalez | E02D 29/0241 405/262 |
| 5,456,554 | A * | 10/1995 | Barrett | E02D 29/025 405/262 |
| 9,103,089 | B2 * | 8/2015 | Ogorchock | E02D 29/0266 |
| 9,523,178 | B2 * | 12/2016 | Ferraiolo | E02D 5/80 |
| 2001/0014255 | A1 * | 8/2001 | Orsat | E02D 29/0241 405/15 |
| 2006/0051166 | A1 * | 3/2006 | Lee | E02D 29/0233 405/284 |
| 2014/0270991 | A1 * | 9/2014 | Ogorchock | E02D 29/0266 405/286 |

* cited by examiner

WATER-BLOCKING DEVICE

CROSS-REFERENCE TO RELATED APPLICATIONS

The present application claims priority to Japanese Application No. 2016-012267, filed Jan. 26, 2016, the content of which is hereby incorporated by reference in its entirety.

TECHNICAL FIELD

The present invention relates to a water-blocking device for preventing water from flowing into structures, such as houses, buildings, subways, and underground passages, from an open space on the floor, such as an entrance or exit, in a flood by damming water at a specific location in the open space. In particular, the present invention relates to a water-blocking device that can be easily installed even on existing structures.

BACKGROUND ART

Conventionally, when the volume of water on the ground surface increases due to heavy rain or the like, water may flow into buildings from entrances or exits, such as building hallways. Accordingly, in order to prevent water intrusion into buildings, sandbags have been piled up on the opening frontage and covered with a tarpaulin or the like to provide simple water-blocking equipment.

However, the hand-carrying and piling of sandbags take much labor and time. As an emergency countermeasure, this method has a problem in work efficiency. In particular, it is difficult for women, elderly people, etc., to perform such work. While it is difficult to quickly obtain soil to be packed in the sandbags, preparing sandbags with soil packed therein beforehand also has a problem because a large storage space is required for the sandbags. Furthermore, the disposal of sandbags after use, etc., is also troublesome.

Accordingly, various water-blocking devices have been proposed that can be installed at the entrances or exits, etc., of buildings (see, for example, Patent Literature 1 (PTL 1). The water-blocking device disclosed in PTL 1 is such that after a grounding plate is placed on the floor surface at a building entrance or exit and a water-blocking plate is dropped down while fitting both end portions of the water-blocking plate into both-side rail members secured to both end portions of the grounding plate, a first pressurizing device is operated to press the water-blocking plate downward, thereby compressively deforming a packing material disposed between the grounding plate and the water-blocking plate, while a second pressurizing device is operated to press the water-blocking plate forward, thereby compressively deforming a packing material disposed between the water-blocking plate and each of the rail members, so that a water-tight state is established between the water-blocking plate and the grounding plate and between the water-blocking plate and the rail members.

CITATION LIST

Patent Literature

PTL 1: JP2001-329759A

SUMMARY OF INVENTION

Technical Problem

However, since the water-blocking device disclosed in PTL 1 is such that the grounding plate and the rail members are integrally formed by welding or the like, the device requires a large storage space when it is not in use. It is also inconvenient to handle such a device during assembly and/or disassembly. Furthermore, when the water-blocking device is assembled, the first and second pressurizing devices must be operated and the assembly work is also not easy.

In view of these problems, the present invention has been accomplished. An object of the present invention is to provide a water-blocking device that can be easily installed in a short time, that can surely prevent water intrusion, and that does not require a large storage space when it is not in use.

Solution to Problem

The above object of the present invention can be achieved by a water-blocking device comprising:

a water-blocking plate installed on a floor surface in an open space of a structure;

a first band for fixing the water-blocking plate to the floor surface; and at least one first band passer mounted near the installation location of the water-blocking plate on the floor surface, wherein the water-blocking plate comprises at least one second band passer, and the first band is wound through the first band passer and the second band passer in such a manner that a pressing force toward the floor surface is exerted onto the water-blocking plate.

Preferably, the water-blocking device having the above structure further comprises third band passers mounted on right and left columns or walls defining the width of the open space, and second bands for fixing the water-blocking plate to the columns or walls, wherein the water-blocking plate comprises a pair of left and right fourth band passers, and the second bands is wound through the third band passers and the fourth band passers in such a manner that pressing forces toward the columns or walls are exerted onto the water-blocking plate.

In this embodiment, more preferably, the at least one second band passer is a pair of upper and lower band passers mounted on the water-blocking plate, and the first band is wound through the first band passer and the second band passers in such a manner that the first band is substantially vertical between the upper and lower second band passers. Even more preferably, the first band passer is mounted on the floor surface at the structure side as viewed from the installation location of the water-blocking plate, and the water-blocking plate is supported by the columns or walls at the side opposite to the structure.

In above preferable embodiments, the water-blocking plate may comprise a projection projecting from the plate surface below the second band passer, and the first band may be wound through the first band passer and the second band passer in such a manner that the first band rides over the projection and is substantially vertical between the projection and the first band passer.

In the water-blocking device having the above structure, a buffer, a caulking material, a packing material, and a caulking material are preferably disposed in this order between the floor surface and the water-blocking plate.

In the water-blocking device having the above structure, the water-blocking plate may comprise plate members connected to each other. An end face of one of the adjacent plate members may be provided with a tongue, whereas an end face of another of the adjacent plate members may be provided with a groove to be engaged with the tongue. A water-blocking tape may be applied to the interface between the adjacent plate members. The water-blocking plate may comprise plate members connected to each other via a frame member. The frame member may comprise a first groove into which one side edge of one of the adjacent plate members is fitted via an adhesive layer, and a second groove into which one side edge of another of the adjacent plate members is fitted via an adhesive layer. A water-blocking tape may be applied to the interface between the adjacent plate members.

In this embodiment, the water-blocking plate preferably further comprises a reinforcing member disposed astride the adjacent plate members, and each of the adjacent plate members comprises a receiver for supporting the reinforcing member.

Advantageous Effects of Invention

The water-blocking device according to the present invention can be easily installed in a short time and can surely block water intrusion. In addition, the storage space required when the device is not in use can be reduced.

DESCRIPTION OF EMBODIMENTS

Figure 1:
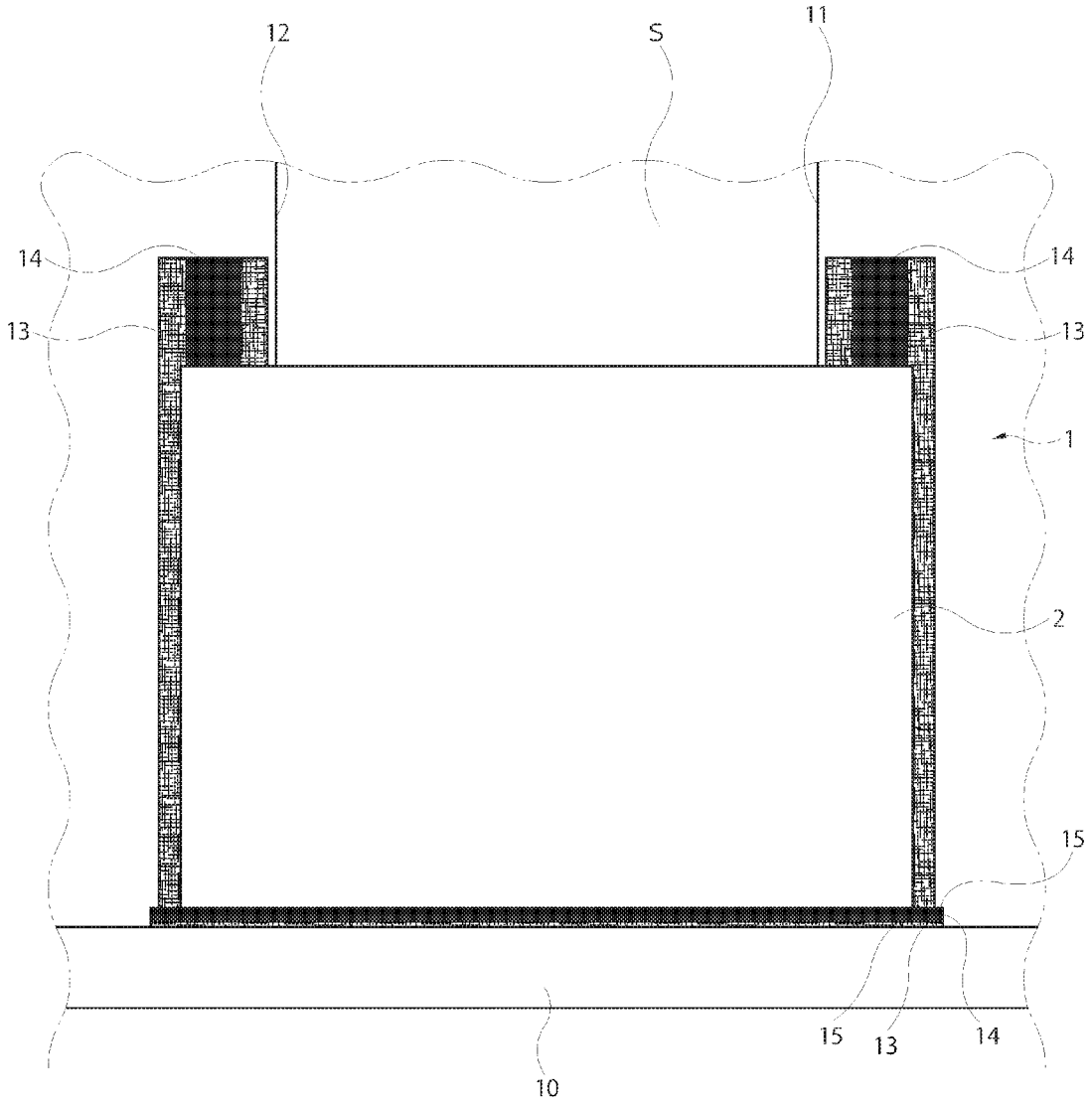
FIG. 1 is a front elevation view of the water-blocking device according to a first embodiment of the present invention.
Figure 2:
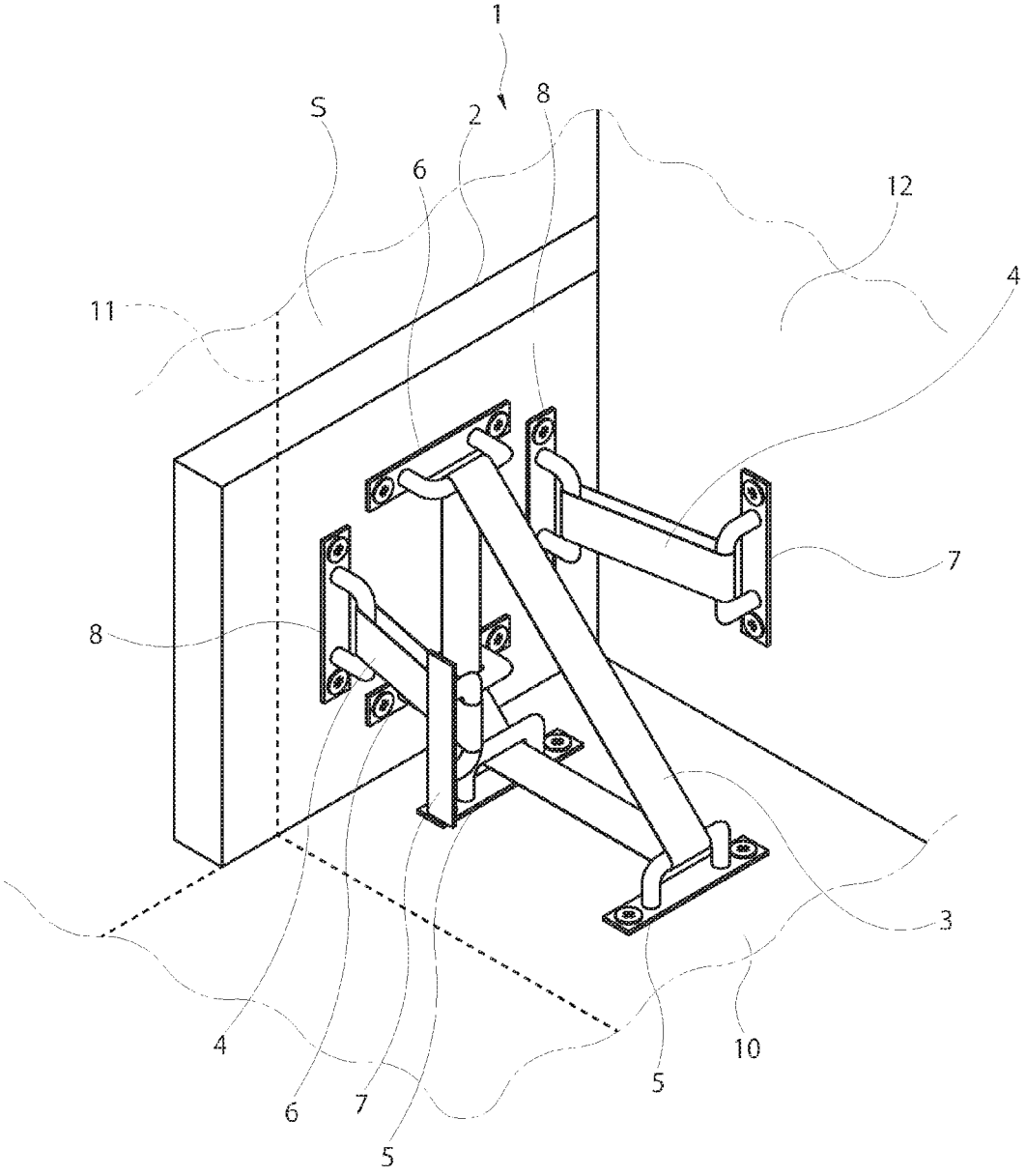
FIG. 2 is an upper rear perspective view of the water-blocking device.

Embodiments of the present invention are described below with reference to the accompanying drawings. FIGS. 1 and 2 illustrate a water-blocking device 1 according to one embodiment of the present invention. In FIGS. 1 and 2, S denotes an open space on the floor surface (installation surface) of a structure, such as a building entrance or exit; 10 denotes a floor surface (installation surface) at a location where water is dammed; 11 and 12 denote left and right columns or walls (hereinafter referred to as "walls, etc.") defining a space (entrance or exit) S where water is dammed. A hinged door, a sliding door, a shutter, or the like that closes the space (entrance or exit) S during normal times is not shown in FIGS. 1 and 2. The water-blocking device 1 according to this embodiment dams water, for example, at a specific location of an entrance or exit so as to prevent water from flowing into a building from the building entrance or exit. The present invention can be applied not only to building entrances or exits but also to entrances or exits of subways and underground passages, etc.

The water-blocking device 1 according to this embodiment comprises a water-blocking plate 2 installed at a building entrance or exit S; a first band 3 for fixing the water-blocking plate 2 to the installation surface 10; second bands 4 for fixing the water-blocking plate 2 to walls, etc. 11, 12; at least one first band passer 5 mounted on the installation surface 10 near the entrance or exit S; and third band passers 7 mounted on left and right walls, etc., 11, 12 defining the entrance or exit S. The water-blocking plate 2 further comprises at least one second band passer 6 and also a pair of left and right fourth band passers 8.

Figure 3:
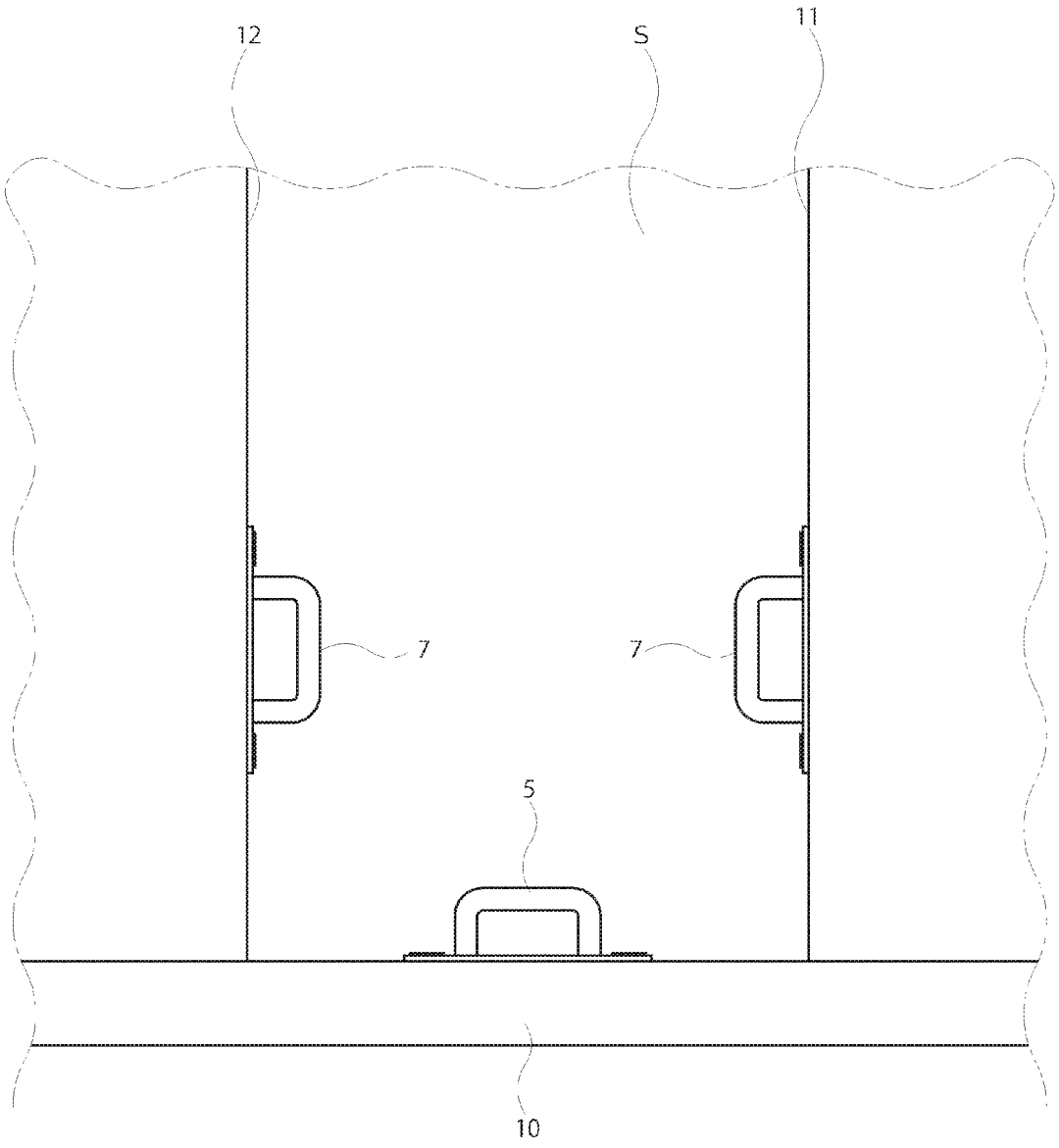
FIG. 3 is a front elevation view of an entrance or exit of a building.
Figure 4:
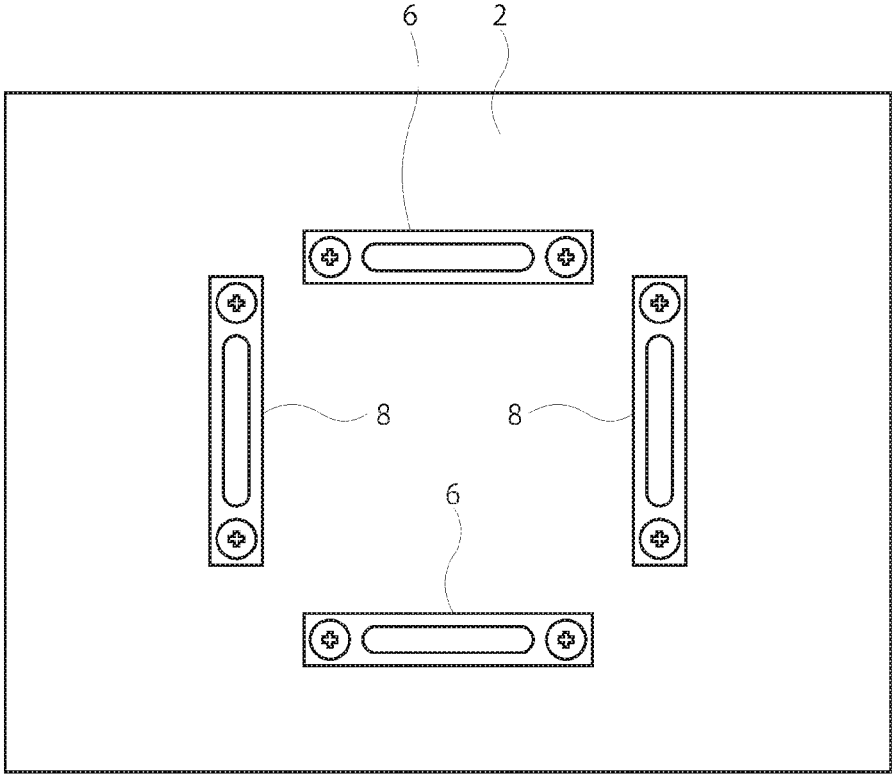
FIG. 4 is a rear view of a water-blocking plate.

As shown in FIGS. 2 and 3, first band passers 5 are fixed near the installation location of the water-blocking plate 2 on the installation surface 10 using, for example, screws or bolts. As shown in FIGS. 2 and 4, second band passers 6 are fixed to one surface (one side) of the water-blocking plate 2, for example, using screws or bolts. As shown in FIGS. 2 and 3, a third band passer 7 is fixed to one side of each of the left and right walls, etc., 11, 12 (i.e., on the opposed inner surfaces of the left and right walls, etc. in FIGS. 2 and 3) near the installation location of the water-blocking plate 2 using, for example, screws or bolts. As shown in FIGS. 2 and 4, fourth band passers 8 are fixed to one side of the water-blocking plate 2 using, for example, screws or bolts.

According to this embodiment, first band passers 5 are mounted on the installation surface 10 behind the entrance or exit S (on the building side) in such a manner that two first band passers 5 are arranged in parallel and front-to-back spaced from each other. A pair of upper and lower second band passers 6 are mounted on the building-facing side of the water-blocking plate 2. The first band 3 extends substantially vertically between the upper and lower second band passers 6. The fourth band passers 8 are mounted on the building-facing side of the water-blocking plate 2 so as to be positioned between a pair of second band passers 6 in the up-down direction and positioned outside of a pair of second band passers 6 in the left-right direction. The third band passers 7 are mounted on the inner surfaces of walls, etc., 11, 12, so as to be positioned below the fourth band passers 8 of the water-blocking plate 2.

The band passers 5 to 8 are made of, for example, metal. Each band passer comprises a flat plate portion for fixing to each site and an insertion portion for inserting a band 3 or 4 therethrough. The shape of the insertion portion is not particularly limited, and may be U-shaped, squared U-shaped, circular, triangular, or any other shape that has an opening through which the band 3 or 4 can be passed. Commercially available products may be used as such band passers 5 to 8. In the examples illustrated in the Figures, first band passers 5 are fixed to the installation surface 10. For example, grooves (not shown) may be formed on the installation surface 10 and the first band passers 5 may be fixed within the grooves. The appearance of the installation surface 10 can be improved in the following manner: the first band passers 5 are made invisible from the outside by closing grooves with covers (not shown) during normal times, whereas when in use, the first band passers 5 are exposed by opening the covers. Similarly, a groove (not shown) may be formed on one side of each of the walls, etc., 11, 12, and third band passers 7 may be fixed within the grooves.

The water-blocking plate 2 according to this embodiment has a horizontally elongated rectangular shape, as shown in FIGS. 2 and 4. The water-blocking plate 2 may be formed, for example, using wood. However, to reduce weight, the water-blocking plate 2 may be formed, for example, using plastic and may be hollow inside. In this case, it is desirable to enhance the strength by, for example, providing ribs at inner and/or outer appropriate sites. Alternatively, a compression-resistant forming agent, such as polyethylene, may be used as a core material, and a decorative plate made of a metal or wood may be bonded to both front and back surfaces of the core material using an adhesive or the like, whereby weight can be reduced while maintaining the strength of the water-blocking plate 2.

The water-blocking plate 2 is supported by the installation surface 10 and also supported by walls 11, 12, etc. on the side opposite to the building. The water-blocking plate 2 is installed in such a state that a buffer 13 and a packing material 14 are placed over the full length between the water-blocking plate 2 and the installation surface 10, in this order from the side of the installation surface 10.

The buffer 13 may be, for example, straw. The presence of the buffer 13 between the water-blocking plate 2 and the installation surface 10 prevents damage to the installation surface 10 even when the first band 3 presses the water-blocking plate 2 against the installation surface 10 as described below. Examples of the packing material 14 include rubber and like elastomers, felts and sponges. When the first band 3 presses the water-blocking plate 2 against the installation surface 10 with the packing material 14 being disposed between the water-blocking plate 2 and the installation surface 10, the packing material 14 is compressively deformed, whereby a water-tight state is established between the water-blocking plate 2 and the installation surface 10.

Further, a sufficient amount of a caulking material 15 is applied to the buffer 13 and the packing material 14 and also to the gap between the packing material 14 and the water-blocking plate 2, whereby the gaps between each component are filled with the caulking material 15, thus achieving a more water-tight state between the water-blocking plate 2 and the installation surface 10. The caulking material 15 may be a commercially available caulking material for construction (e.g., "Cemedine Polycaulk" produced by Cemedine Co., Ltd.).

The water-blocking plate 2 is also supported in such a state that a buffer 13 and a packing material 14 are placed over the full length between the water-blocking plate 2 and each of right and left walls, etc., 11, 12 in this order from the side of each wall, etc., 11, 12. Due to the presence of the buffer 13 and the packing material 14 between the water-blocking plate 2 and each of the walls, etc., 11, 12, damage to walls, etc., 11, 12 is similarly prevented even when the water-blocking plate 2 is pressed against the walls, etc., 11, 12, and a water-tight state is established between the water-blocking plate 2 and each of the walls, etc., 11, 12. Further, a sufficient amount of a caulking material 15 is applied to the buffer 13 and the packing material 14 and also to the gap between the packing material 14 and the water-blocking plate 2, whereby the gaps between each component are filled with the caulking material 15, thus achieving a more water-tight state between the water-blocking plate 2 and each of the walls, etc., 11 and 12.

The size of the water-blocking plate 2 is not particularly limited and can be suitably designed according to the dimensions of the entrance or exit (length and width). For example, the length may be 50 cm to 90 cm and the width may be 100 cm to 200 cm.

As shown in FIG. 2, the first band 3 is wound through the first band passers 5 on the installation surface 10 and through the second band passers 6 on the water-blocking plate 2. The first band 3 exerts a pressing force toward the installation surface 10 onto the water-blocking plate 2. Therefore, the water-blocking plate 2 is brought into tight contact with and firmly fixed to the installation surface 10. According to this embodiment, a pair of upper and lower second band passers 6 are mounted on the water-blocking plate 2. The first band 3 is wound through the first band passers 5 and the second band passers 6 in such a manner that the first band 3 is substantially vertical between the upper and lower band passers 6. Therefore, a vertically downward pressing force is effectively exerted onto the water-blocking plate 2, and the water-blocking plate 2 is brought into tight contact with and firmly fixed to the installation surface 10. A pair of upper and lower second band passers 6 are not necessarily provided on the water-blocking plate 2. Even only one second band passer 6 can exert a vertically downward pressing force onto the water-blocking plate 2.

In addition, because the first band 3 is wound through the first band passers 5 mounted behind the water-blocking plate 2, a pressing force toward the walls, etc. 11, 12, disposed behind the water-blocking plate 2 is also exerted onto the water-blocking plate 2, whereby the water-blocking plate 2 is brought into tight contact with and firmly fixed to the walls, etc., 11, 12. Furthermore, as shown in FIG. 2, because the second bands 4 are wound through the third band passers 7 on the walls, etc., 11, 12 and the fourth band passers 8 on the water-blocking plate 2 to exert pressing forces toward the walls, etc., 11, 12 onto the water-blocking plate 2, horizontally inward pressing forces are effectively exerted onto the water-blocking plate 2, so that the water-blocking plate 2 can be brought into tight contact with and firmly fixed to the walls, etc., 11, 12. A pair of front and back first band passers 5 are not necessarily provided on the installation surface 10. Even only one band passer 5 can exert vertically downward and horizontally inward pressing forces onto the water-blocking plate 2.

Figure 5:
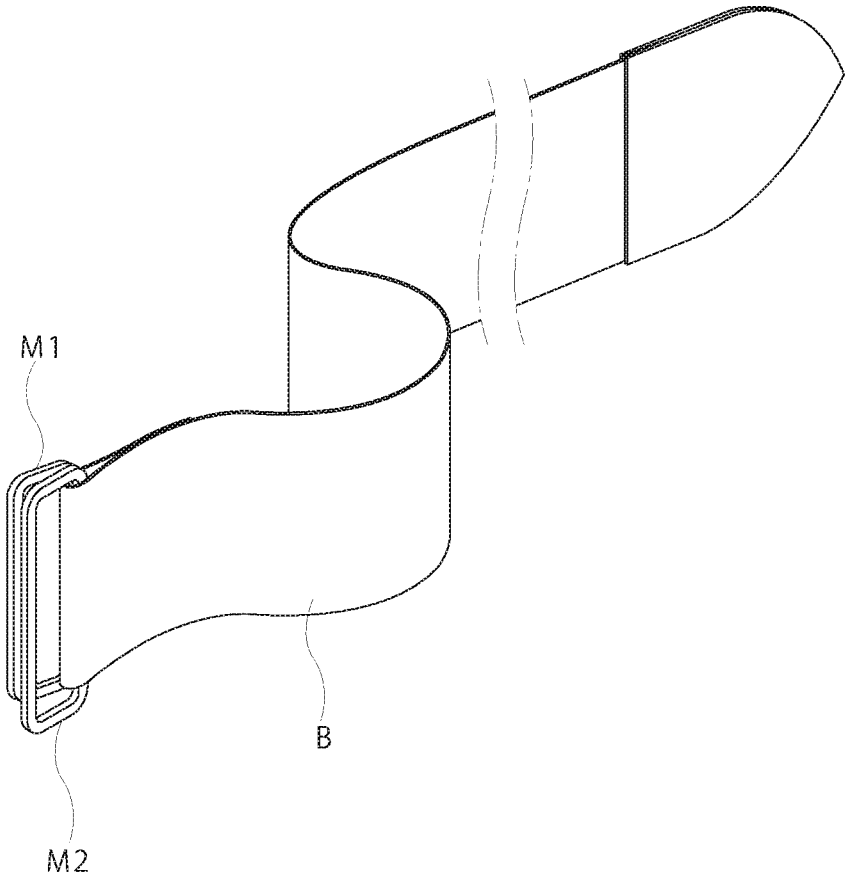
FIG. 5 is a perspective view of a band.

The first band 3 and the second band 4 may be strip-shaped or belt-shaped (have a belt-like shape) as long as they are elongated objects having a certain length. The first band 3 and the second band 4 may be elastic or non-elastic. Suitable examples of such bands 3, 4 are suitcase bands (suitcase belts) as shown in FIG. 5, which are sold as items to be wound around travel suitcases.

A suitcase band of this type is provided with two square cans (metal fittings) M1, M2 on one end (first end) of a band B. The other end (second end) of the band B is passed through each band passer to wind the band B one revolution and then passed through the first and second square cans M1, M2. After the band B is folded back and the second end of band B is inserted into the first square can M1 from the space between the first square can M1 and the second square can M2, the band B is strongly pulled, whereby the band B can be wound through each band passer while easily preventing the band B from loosening. In this embodiment, providing a means for fixing the second end of the band B folded back can surely prevent band B from loosening.

Figure 6:
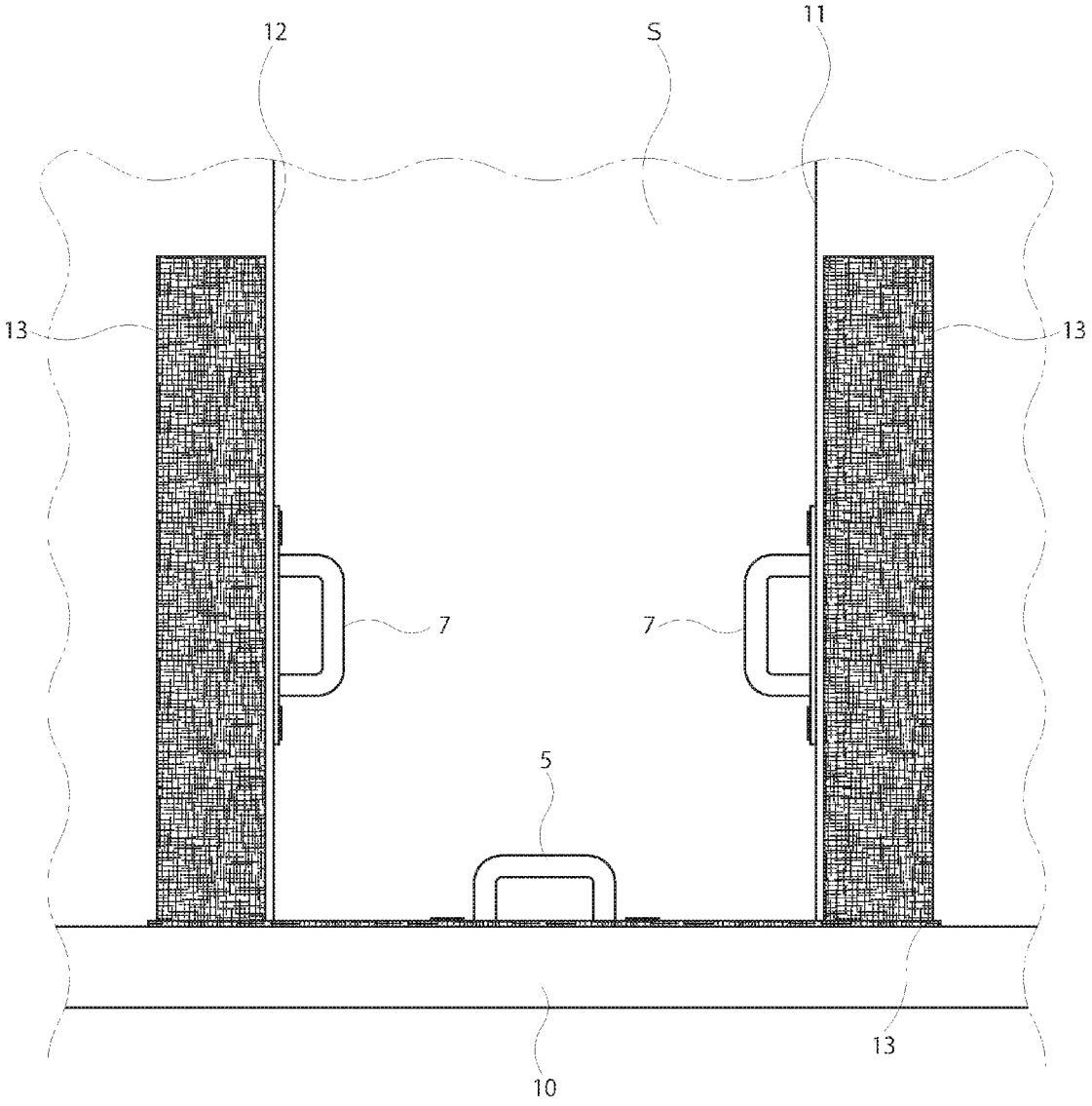
FIG. 6 is a front elevation view of a procedure for installing the water-blocking device at an entrance or exit.

Next, the method for installing the water-blocking device 1 having the above structure is explained below. First, as shown in FIG. 6, a buffer 13, such as straw, is placed over the full length at the location where the water-blocking plate 2 is installed on the installation surface 10. The buffer 13 can be fixed to the installation surface 10 by applying both ends of the buffer, for example, with a gummed cloth tape, etc. A buffer 13, such as straw, is also placed over the full length at the positions on the walls, etc., 11, 12 where the water-blocking plate 2 comes into contact. The buffer 13 can be similarly fixed to walls, etc., 11, 12 by applying both ends of the buffer 13, for example, with a gummed cloth tape, etc.

Figure 7:
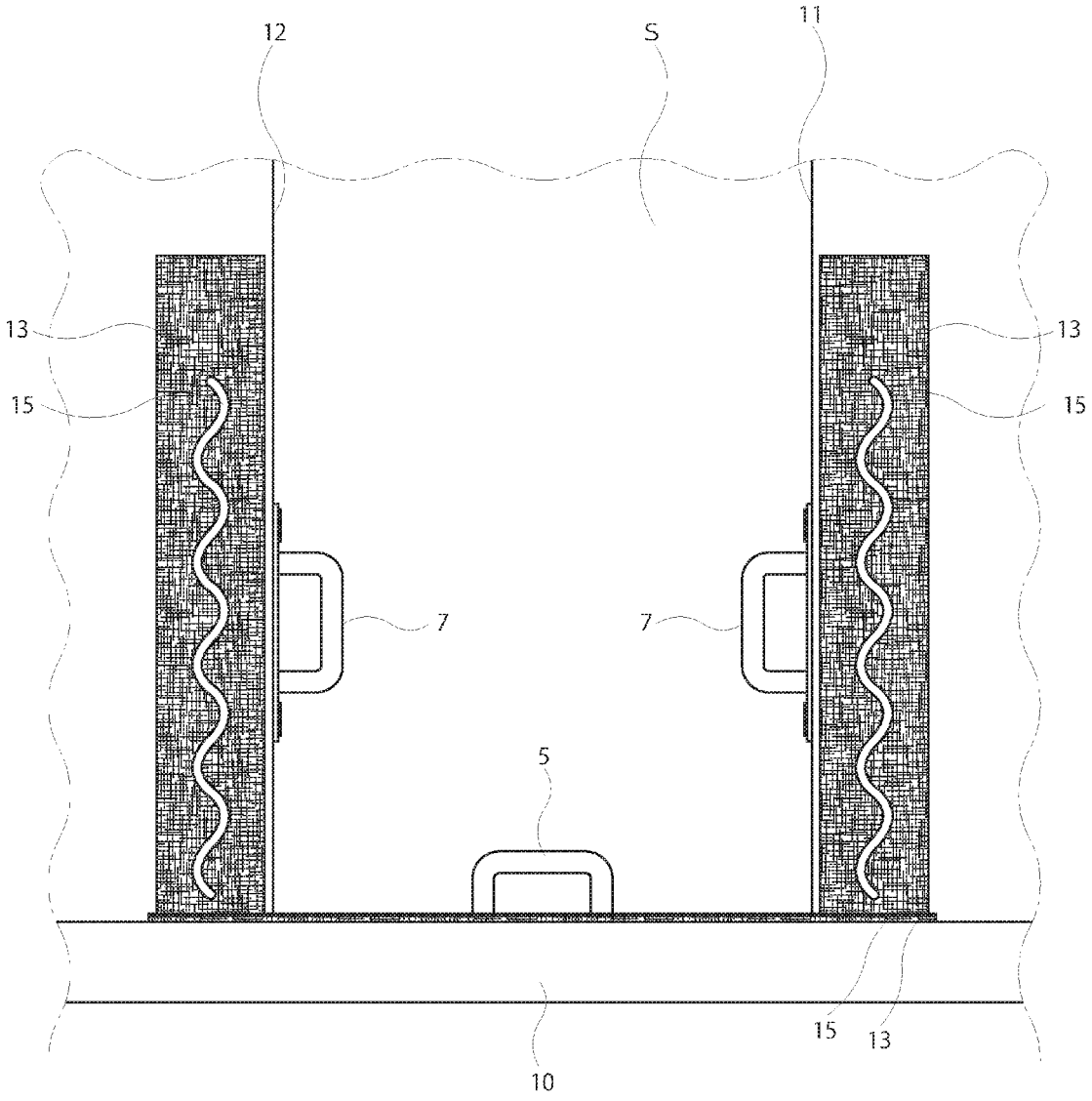
FIG. 7 is a front elevation view of a procedure for installing the water-blocking device at the entrance or exit.

Next, as shown in FIG. 7, a caulking material 15 is applied to the buffer 13 on the installation surface 10 and the walls, etc., 11, 12. A particularly sufficient amount of the caulking material 15 is preferably applied to the corners between the installation surface 10 and each of the walls, etc., 11, 12.

Figure 8:
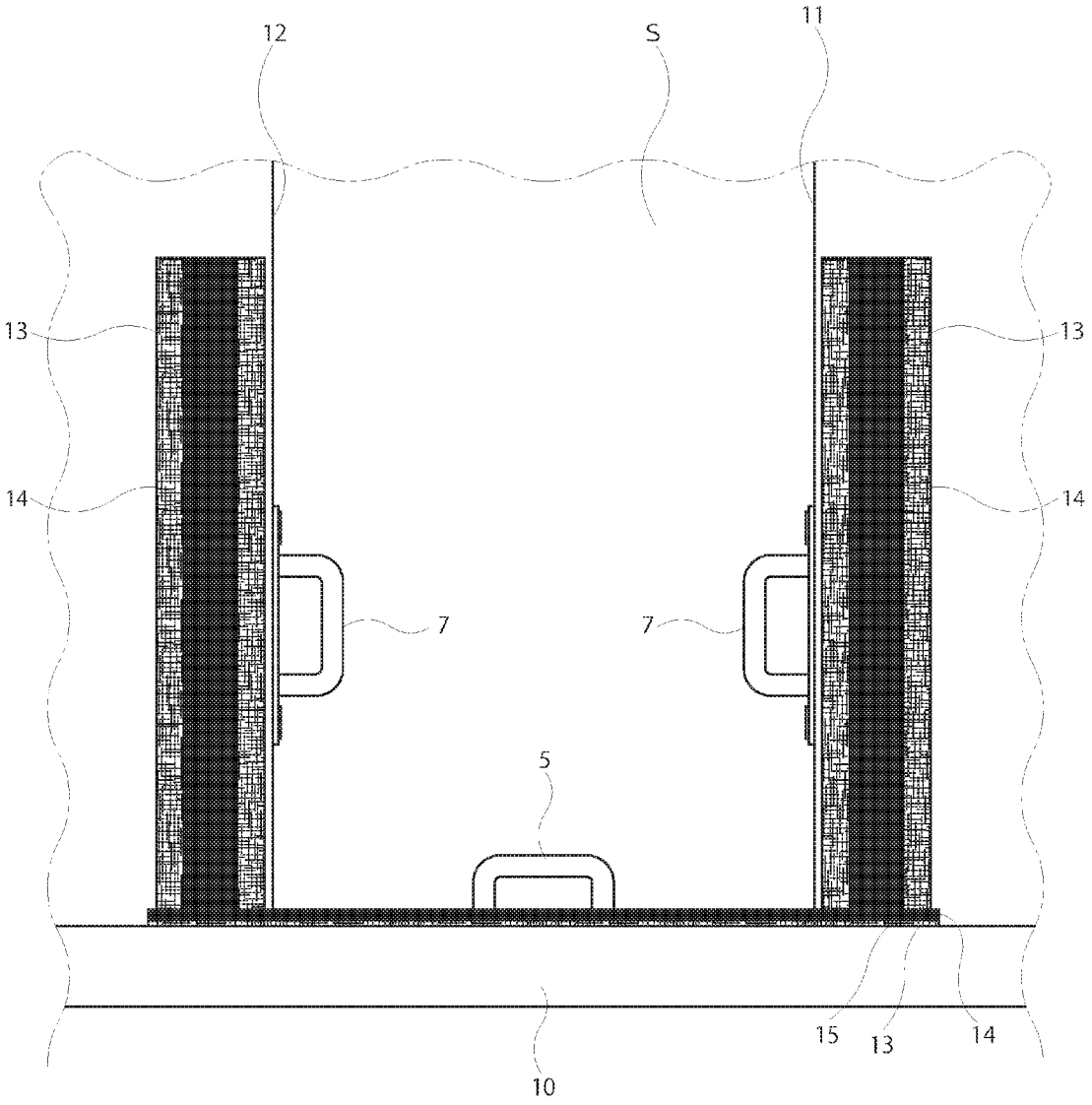
FIG. 8 is a front elevation view of a procedure for installing the water-blocking device at the entrance or exit.
Figure 9:
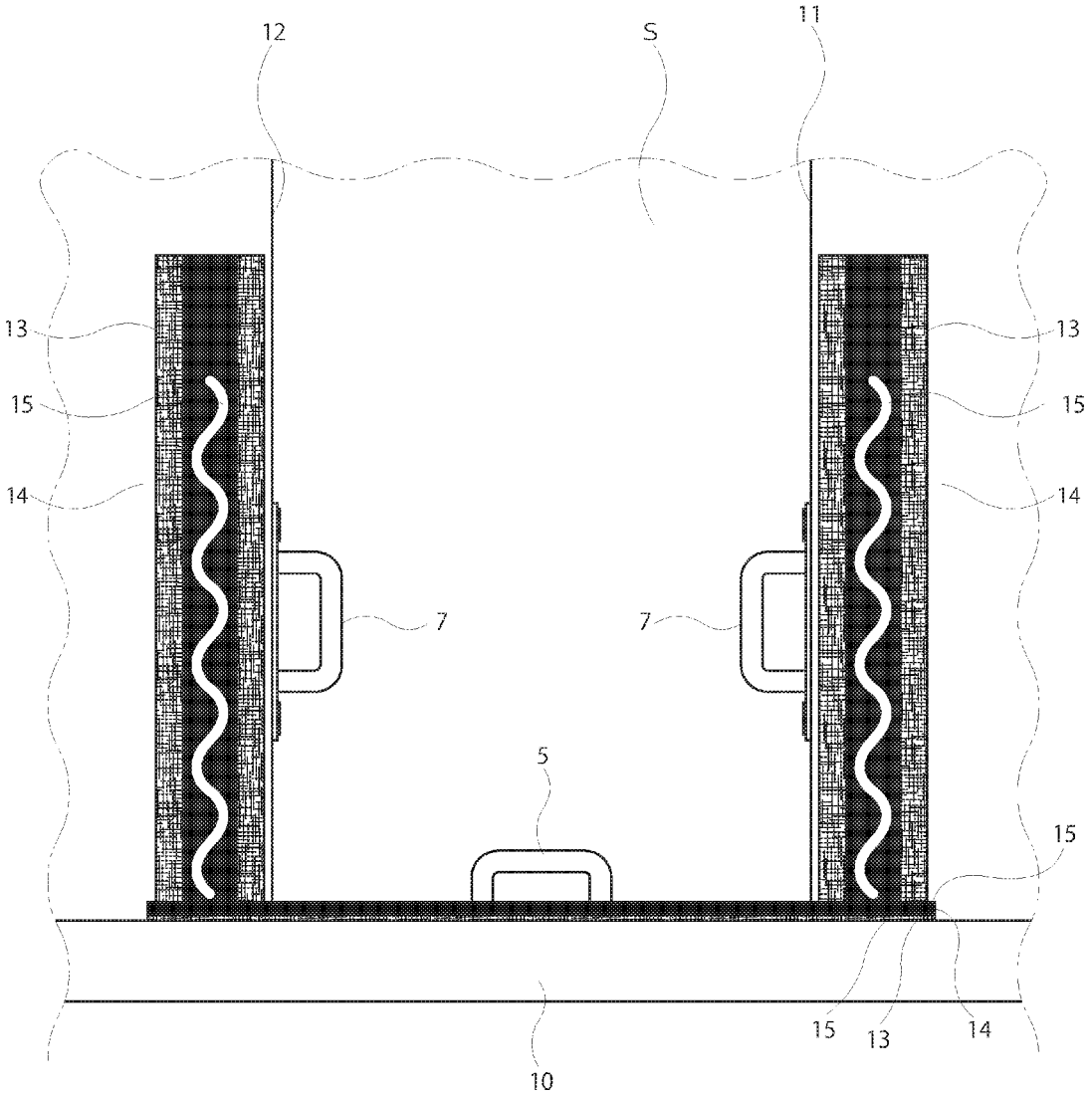
FIG. 9 is a front elevation view of a procedure for installing a water-blocking device at the entrance or exit.
Figure 10:
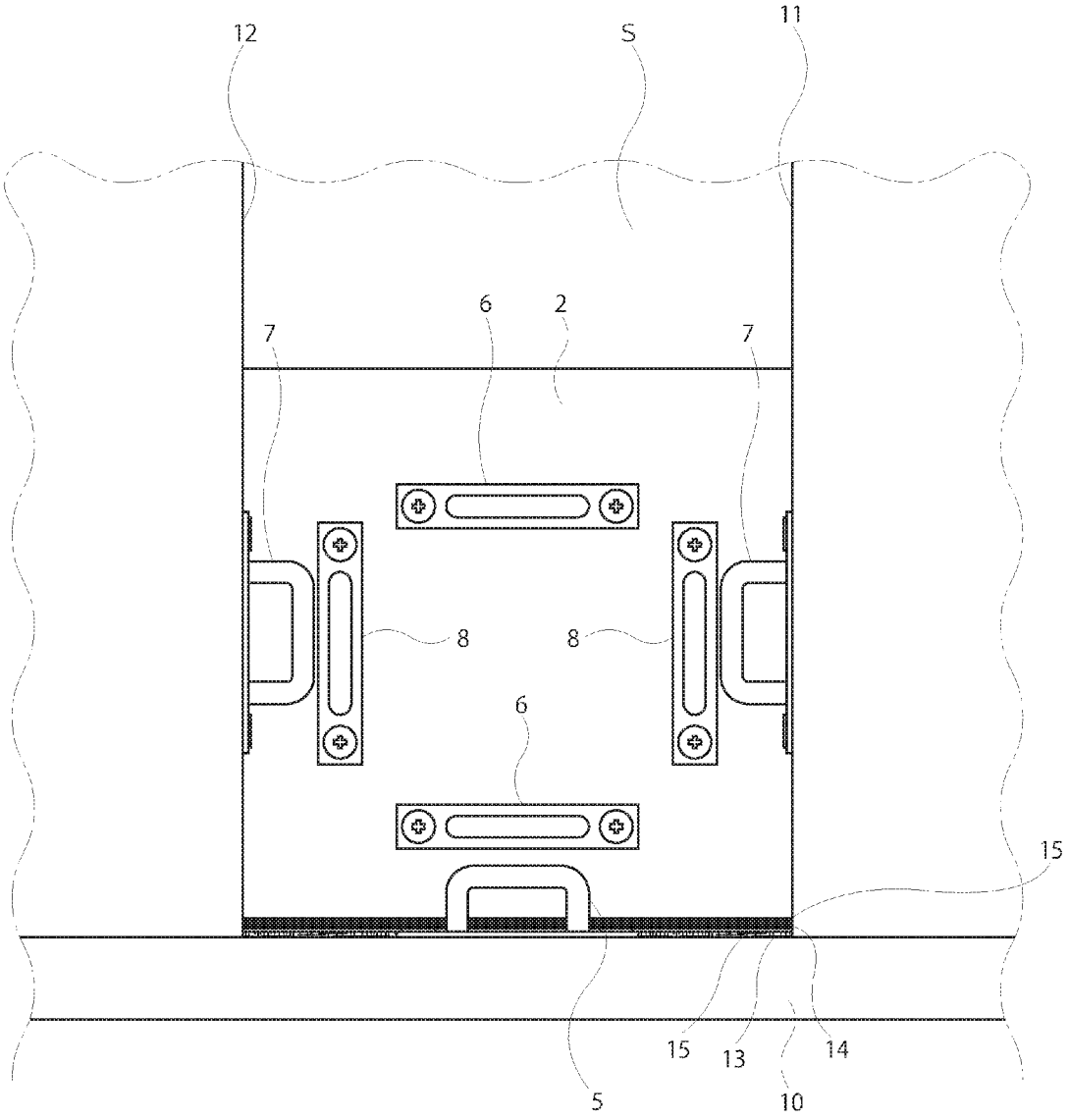
FIG. 10 is a rear view of a procedure for installing the water-blocking device at the entrance or exit.

Next, as shown in FIG. 8, a packing material 14, such as a rubber sheet, is applied to the caulking material 15-coated buffer 13 using a pressure-sensitive adhesive, an adhesive, an adhesive tape, etc. At this time, if a gap is formed at the corner between the installation surface 10 and each of the walls, etc., 11, 12, the gap is preferably filled with the caulking material 15. After the caulking material 15 is applied again onto the packing material 14 as shown in FIG. 9, the water-blocking plate 2 is placed on the caulking material-coated packing material 14 as shown in FIG. 10.

Finally, the first band 3 is strongly wound through the first band passers 5 and the second band passers 6, while the second band passer 4 is strongly wound through the third band passers 7 and the fourth band passers 8, whereby the water-blocking plate 2 is fixed to the installation surface 10 and walls, etc., 11, 12.

According to the water-blocking device 1 of this embodiment, the water-blocking plate 2 is brought into tight contact with and firmly fixed to the installation surface 10 and the right and left walls, etc., 11, 12 by the first band 3 and the second bands 4, respectively, with a caulking material 15 and a packing material 14 being disposed between each component, whereby a water-tight state is established between the water-blocking plate 2 and the installation surface 10 and between the water-blocking plate 2 and each of the walls, etc., 11, 12. Accordingly, even when water flows out during a flood due to heavy rain or the like, water is effectively prevented from flowing into a structure from an open space S on the floor, such as an entrance or exit. Furthermore, even if water pressure is applied to the water-blocking plate 2, there is no fear of the water-blocking plate 2 being removed from the walls, etc., 11, 12 because the water-blocking plate 2 is supported by the walls, etc., 11, 12. Therefore, the water-blocking plate 2 has excellent durability.

According to the water-blocking device 1 of this embodiment, the water-blocking plate 2 can be fixed to the installation surface 10 and to the left and right walls, etc., 11, 12 by the first band 3 and the second bands 4. Therefore, assembly and disassembly are easy, and prompt action can be taken in emergencies. Further, a reduction in the weight of the water-blocking plate 2 enables convenient handling during assembly and disassembly. Furthermore, no large storage space is necessary for the water-blocking plate 2, thus saving space.

According to the water-blocking device 1 of this embodiment, commercially available products can be used as the water-blocking plate 2, bands 3, 4, band passers 5 to 8, buffer 13, packing material 14, and caulking material 15. Therefore, necessary materials can be easily obtained at low cost.

Further, when the device is configured so that during normal times, the first band passers 5 on the installation surface 10 and the third band passers 7 on the walls, etc., 11, 12 are hidden, adverse effects to the appearance can be prevented.

Although one embodiment of the present invention is described above, the present invention is not limited to the above embodiment. Various modifications can be made without departing from the scope or spirit of the present invention.

For example, according to the above embodiment, the second band passers 6 and the fourth band passers 8 are provided on the structure-facing side of the water-blocking plate 2. Alternatively, however, the second band passers 6 and the fourth band passers 8 may be provided on the side thereof opposite to the structure.

Figure 11:
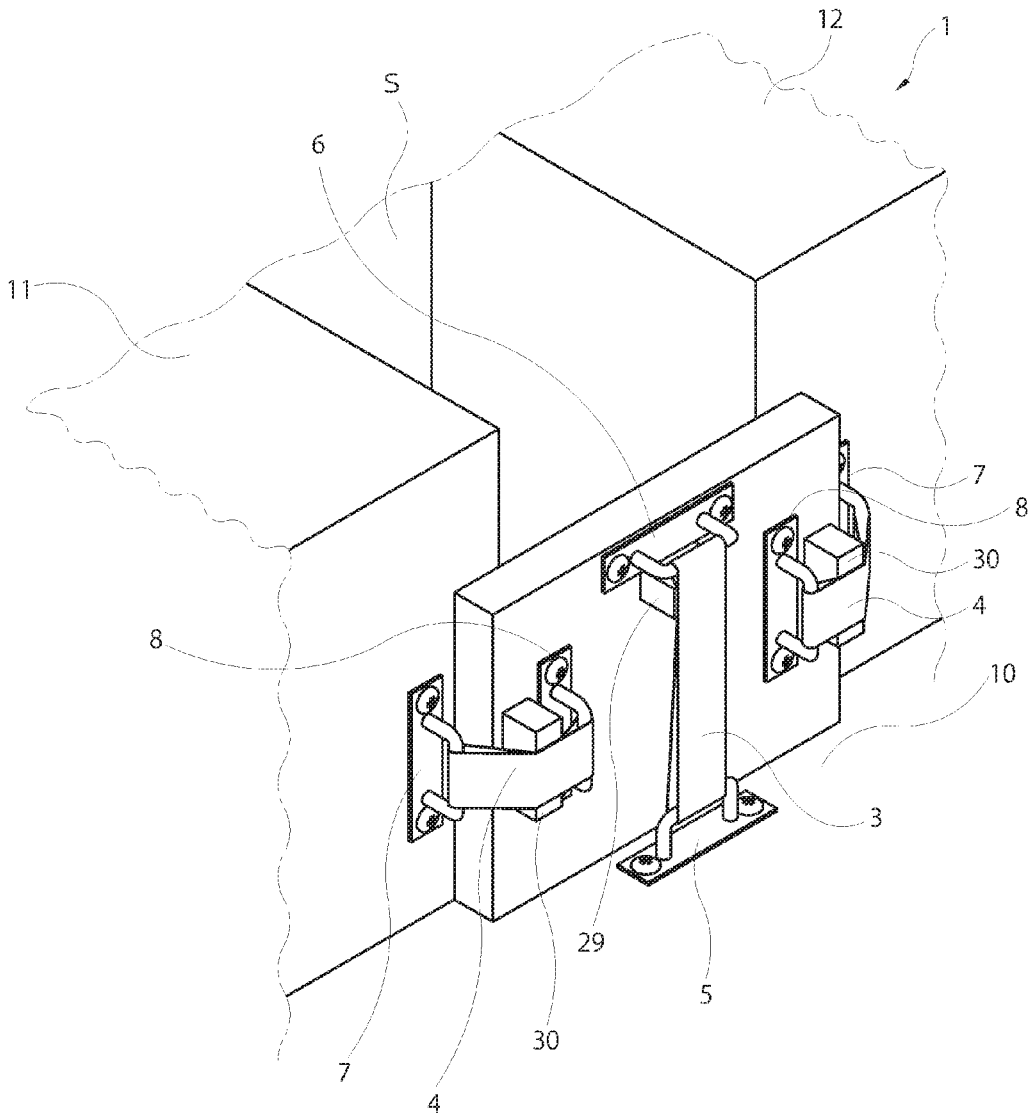
FIG. 11 is an upper front perspective view of a water-blocking device according to another embodiment of the present invention.

FIG. 11 shows a water-blocking device 1 according to another embodiment of the present invention. In the water-blocking device 1 according to the embodiment shown in FIG. 11, the basic structure is the same as in the above embodiment. The same reference numerals are assigned to the same elements, and descriptions thereof are omitted.

Figure 12:
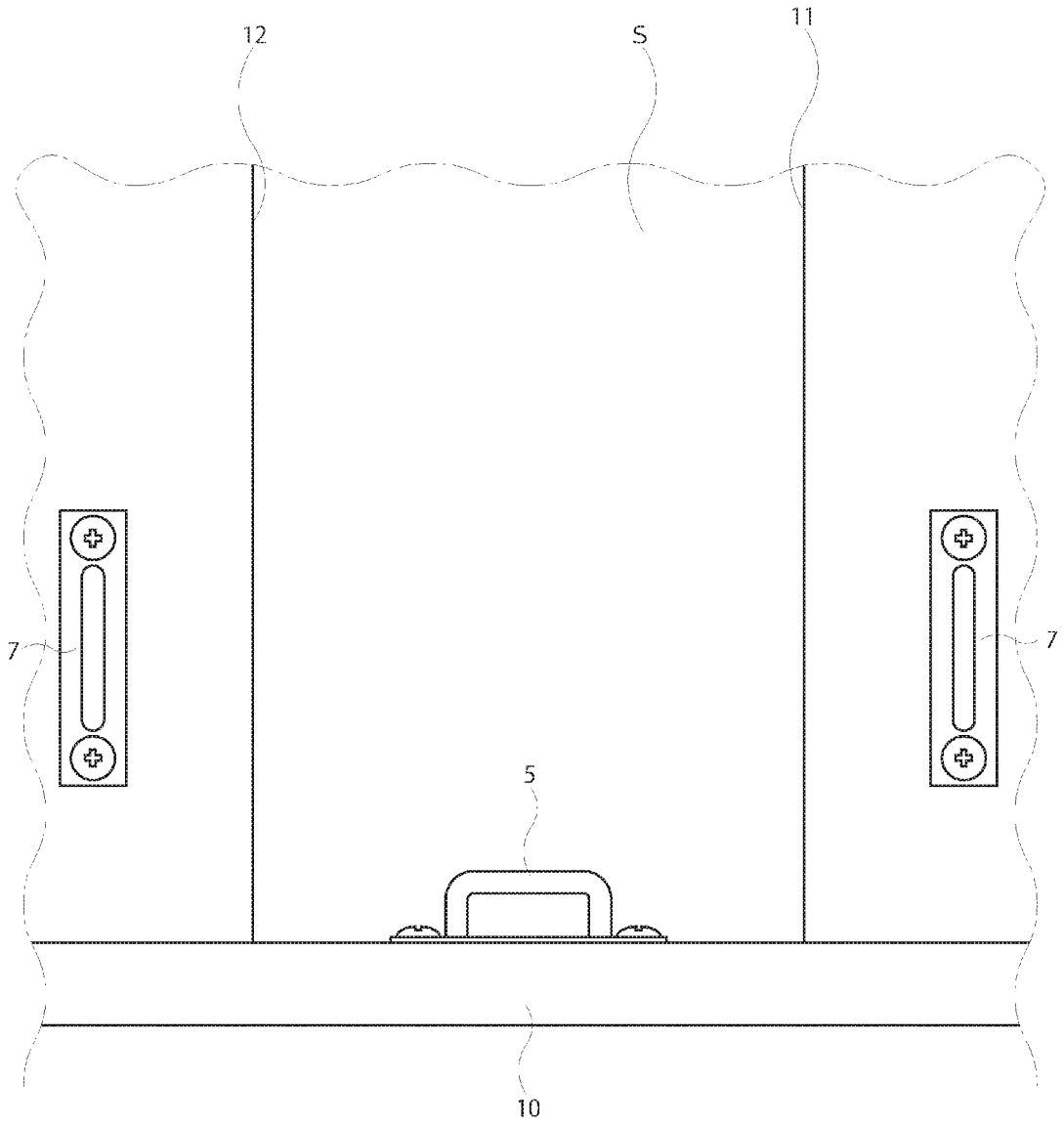
FIG. 12 is a front elevation view of a building entrance or exit.
Figure 13:
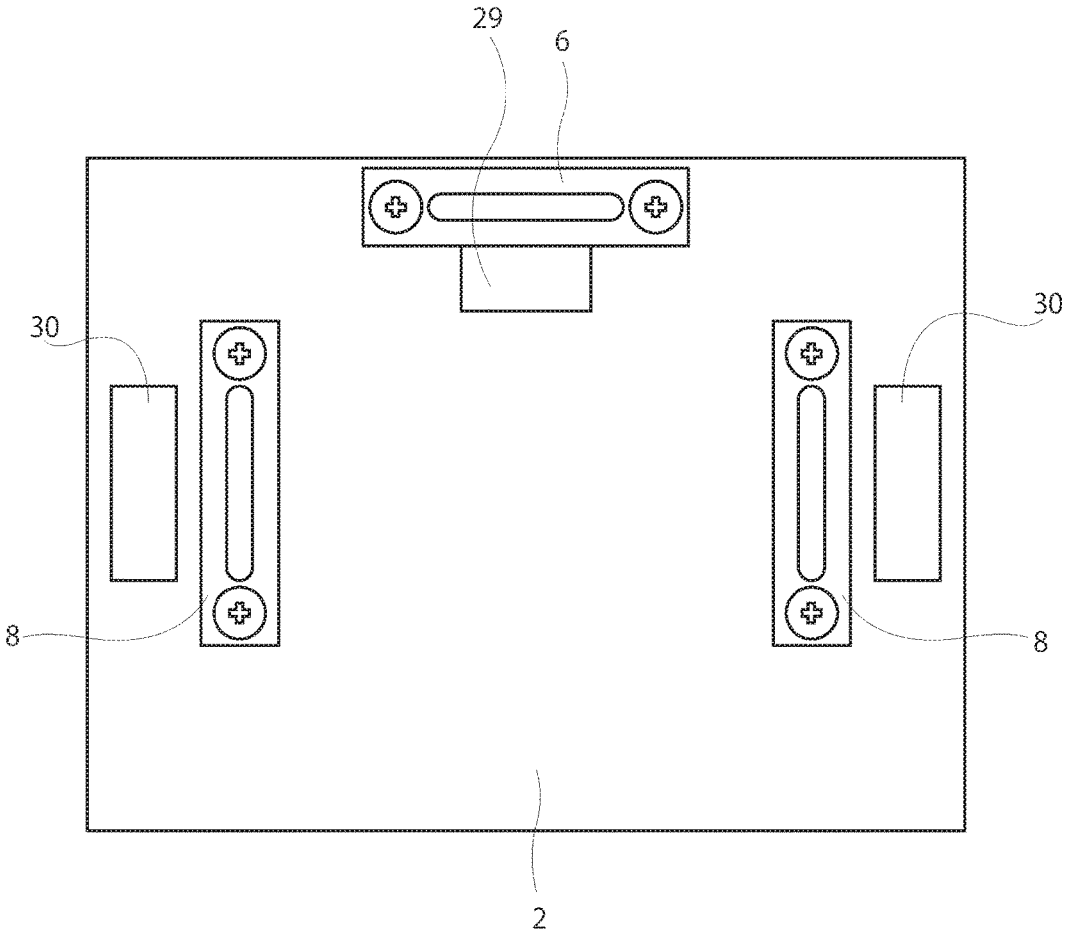
FIG. 13 is a front elevation view of a water-blocking plate.
Figure 15:
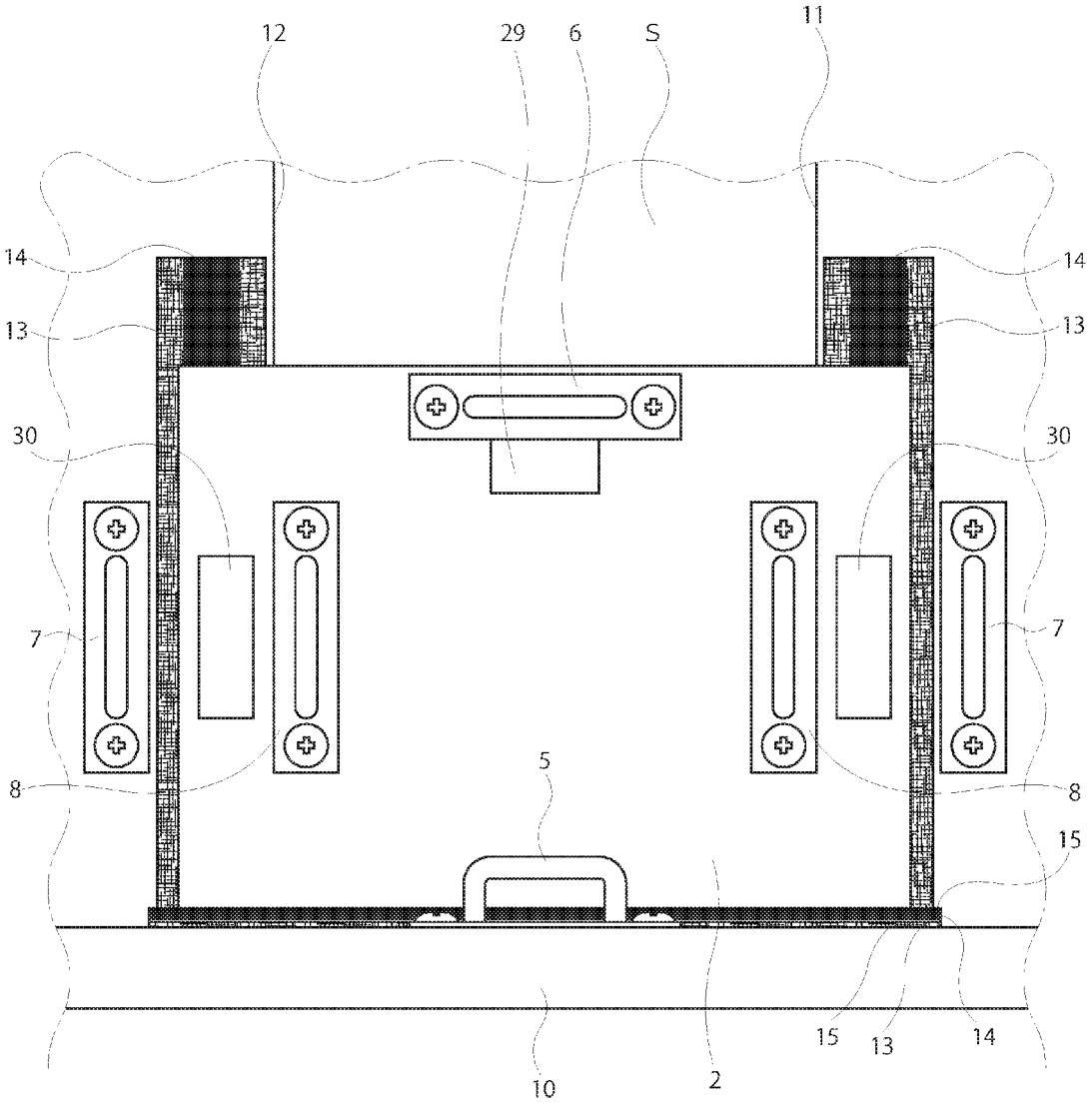
FIG. 15 is a front elevation view of a procedure for installing a water-blocking device at an entrance or exit.

According to this embodiment, first, as shown in FIGS. 11, 12, and 15, one first band passer 5 is mounted on the installation surface 10 near the installation location of the water-blocking plate 2 and ahead of the entrance or exit S (at the side opposite to a structure). As shown in FIGS. 11, 13, and 15, one second band passer 6 is mounted on the opposite side of the water-blocking plate 2 (the plate surface facing away from a structure). As shown in FIGS. 11, 12, and 15, third band passers 7 are provided on the outer surfaces of left and right walls, etc., 11, 12 near the installation location of the water-blocking plate 2. As shown in FIGS. 11, 13, and 15, fourth band passers 8 are mounted on the opposite side of the water-blocking plate 2 so as to be positioned outside of second band passers 6 in the left-right direction. As in the above embodiment, grooves (not shown) may be formed on the installation surface 10 and walls, etc., 11, 12 and both of the first band passer 5 and the third band passers 7 may be fixed within the grooves.

As shown in FIGS. 11, 13, and 15, similar to the above embodiment, the water-blocking plate 2 is supported by the installation surface 10 and also supported by the walls, etc., 11, 12 on the side opposite to a structure, while a buffer 13 and a packing material 14 are placed over the full length between the water-blocking plate 2 and the installation surface 10 and between the water-blocking plate 2 and each of the walls, etc., 11, 12. Further, a sufficient amount of a caulking material 15 is applied to the buffer 13 and the packing material 14 and also to the gap between the packing material and the water-blocking plate 2, whereby the gaps between each component are filled, thus achieving a water-tight state.

The water-blocking plate 2 is provided with a projection 29 projecting from the other side (the plate surface not facing a structure) below the second band passer 6. Due to this projection 29, the first band 3 wound through the first band passer 5 and the second band passer 6 is substantially vertical between the projection and the first band passer 5, and a vertically downward pressing force is effectively exerted onto the water-blocking plate 2, so that the water-blocking plate 2 can be brought into tight contact with and firmly fixed to the installation surface 10. The other side of the water-blocking plate 2 is further provided with projections 30 projecting from the plate surface so as to be positioned outside of the fourth band passers 8. Each second band 4 rides over a projection 30 and is wound through a third band passer 7 and a fourth band passer 8.

Because the second bands 4 are wound through the third band passers 7 of the walls, etc., 11, 12 and the fourth band passers 8 of the water-blocking plate 2 and exert horizontally inward pressing forces toward the walls, etc., 11, 12 onto the water-blocking plate 2, the water-blocking plate 2 can be brought into tight contact with and firmly fixed to the walls, etc., 11, 12.

Figure 14:
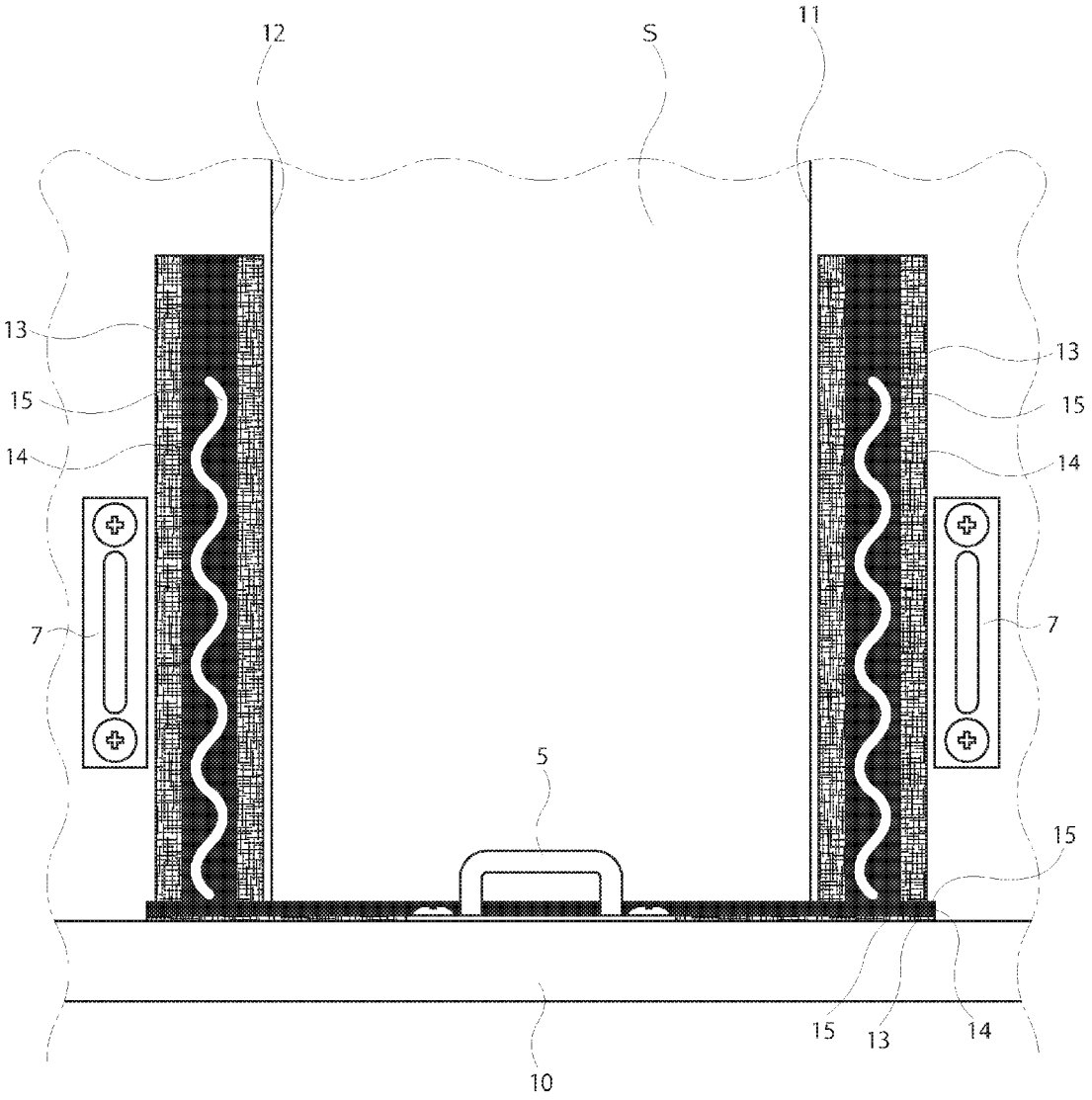
FIG. 14 is a front elevation view of a procedure for installing a water-blocking device at an entrance or exit.

The water-blocking device 1 of this embodiment can be installed with the same procedure as in the above embodiment. Specifically, as shown in FIG. 14, a buffer 13, such as straw, is placed to the full length at the installation location of the water-blocking plate 2 on the installation surface 10 and the portions of the walls, etc., 11, 12, where the water-blocking plate 2 comes in contact. Next, the buffer 13 is coated with a caulking material 15. Subsequently, a packing material 14, such as a rubber sheet, is applied to the caulking material 15-coated buffer 13. After the packing material 14 is coated again with the caulking material 15, the water-blocking plate 2 is placed on the caulking material—coated packing material 14, as shown in FIG. 15. While tightly winding the first band 3 through the first band passer 5 and the second band passer 6, each second band 4 is tightly wound through a third band passer 7 and a fourth band passer 8, whereby the water-blocking plate 2 is fixed to the installation surface 10 and the walls, etc., 11, 12.

The water-blocking device 1 according to this embodiment provides a similar action and effect as in the above embodiment. Specifically, even when water flows out during a flood due to heavy rain or the like, water is effectively prevented from flowing into a structure from a space S on the floor. Further, even if water pressure is applied to the water-blocking plate 2, the water-blocking plate 2 is supported by the walls, etc., 11, 12. Therefore, there is no fear of the water-blocking plate 2 being detached from the walls, etc., 11, 12, so that the water-blocking plate 2 has excellent durability. Further, assembly and disassembly are easy, and prompt action can be taken in emergencies. Furthermore, a reduction in the weight of the water-blocking plate 2 enables convenient handling during assembly and disassembly. Moreover, no large storage space for the water-blocking plate 2 is necessary, thus saving space. Further, necessary materials can be easily obtained at low cost.

According to any of the above embodiments, when the water-blocking plate 2 is installed on the installation surface 10, a packing material 14 is applied to the installation surface 10 and walls, etc., 11, 12 (specifically on the buffer 13) using a pressure-sensitive adhesive, an adhesive, an adhesive tape, etc. The packing material 14 may be applied to appropriate positions of the water-blocking plate 2 beforehand using a pressure-sensitive adhesive, an adhesive, an adhesive tape, etc., with a caulking material 15 being disposed between the packing material 14 and the water-blocking plate 2. In this case, if a gap lies between the packing material 14 applied to the water-blocking plate 2 relative to the installation surface 10 and the packing material 14 applied to the water-blocking plate 2 relative to the walls, etc., 11, 12, the gap is preferably filled with the caulking material 15. In this embodiment, after the buffer 13 is placed on the installation surface 10 and on the walls, etc., 11, 12 and the buffer 13 is coated with the caulking material 15, the water-blocking plate 2 with the packing material 14 is placed on the caulking material-coated buffer 13.

Figure 16:
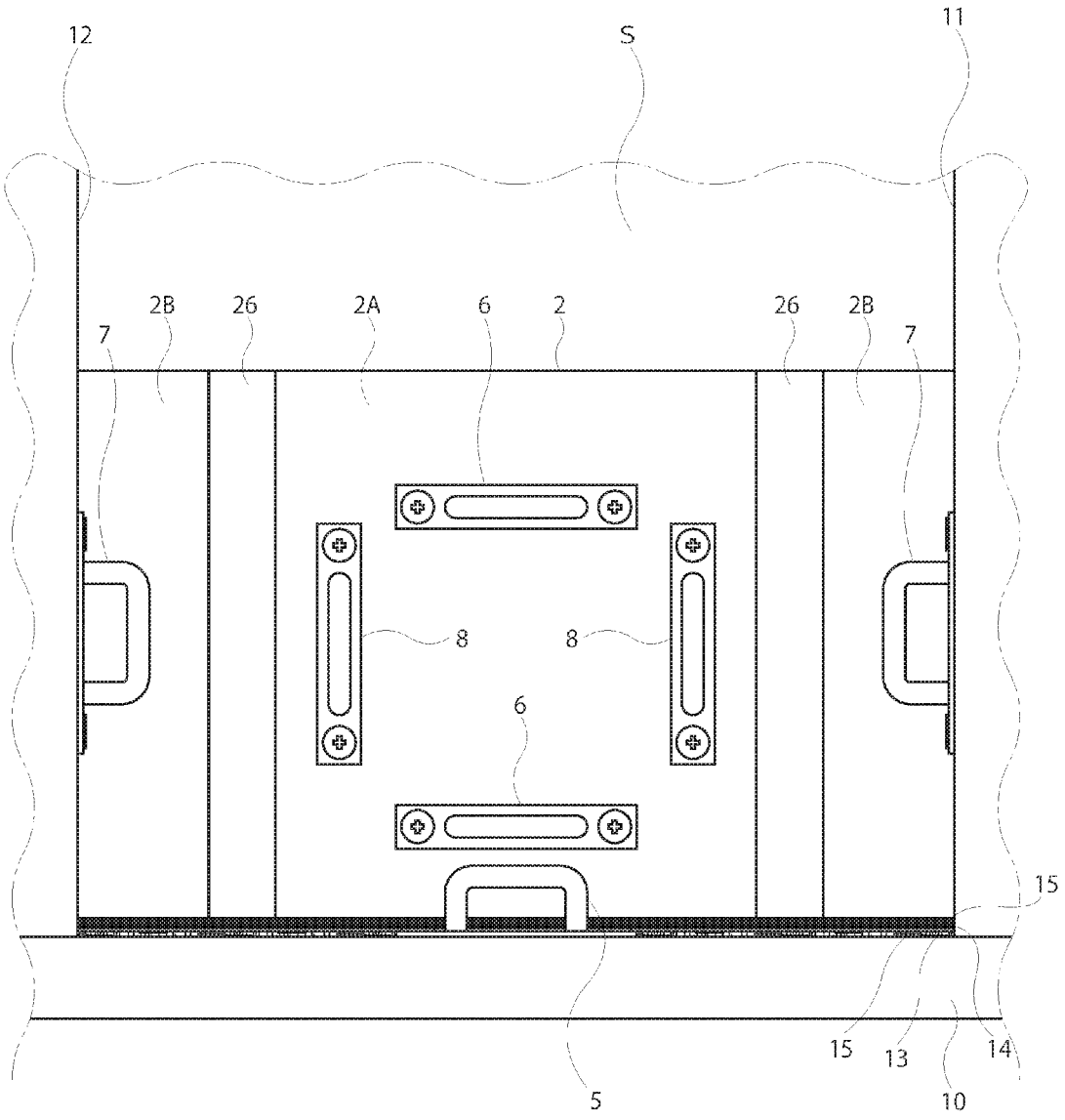
FIG. 16 is a front elevation view showing modification of the water-blocking plate.
Figure 17A:
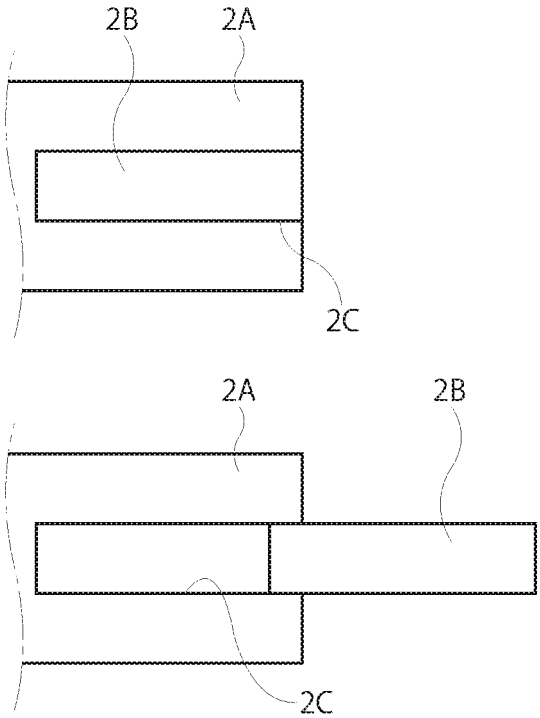
FIGS. 17A and 17B are enlarged plan views of the main portion, illustrated as schematic block diagrams, of examples of slidably mounting auxiliary portion to the body of the water-blocking plate.
Figure 17B:
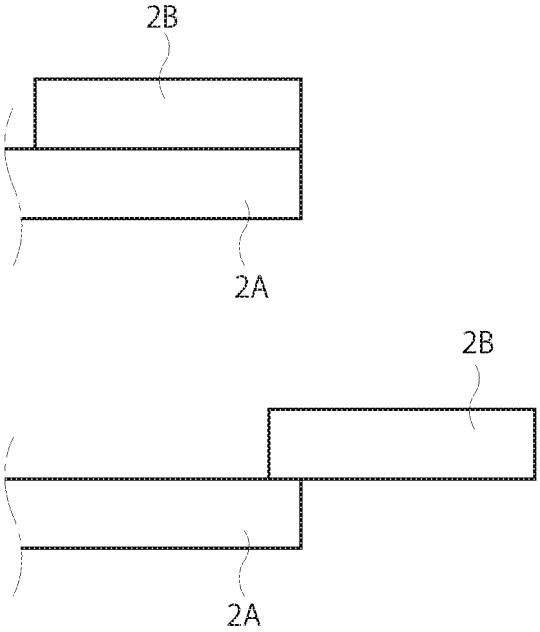

In any of the above embodiments, the water-blocking plate 2 may be configured to be extendible. For example, as shown in FIG. 16, the water-blocking plate 2 may be composed of a body 2A and auxiliary portions 2B that are extendible from and retractable into the left and right edge portions of the body 2A. The auxiliary portions 2B are mounted on the left and right edge portions of the body 2A so as to be slidable in the left-right direction, whereby the auxiliary portions 2B can extend from and retract into the left and right edge portions of the body 2A, thus making the water-blocking plate 2 extendible. When the water-blocking plate 2 is extended as shown in FIG. 16, applying a water-blocking tape 26, such as a gummed cloth tape, to the interface between the body 2A and each auxiliary portion 2B can prevent water intrusion from the interface between the body 2A and each of the auxiliary portions 2B. It is also possible to slidably mount an auxiliary portion 2B on only one of the left and right edge portions of the body 2A. The method for slidably mounting auxiliary portions 2B on the left and right edge portions of the body 2A include, for example, the following. As shown in FIG. 17A, an auxiliary portion 2B is accommodated in a groove 2C formed on the end face of a left or right side edge portion and is configured to be pulled from the groove 2C. Alternatively, as shown FIG. 17B, an auxiliary portion 2B is disposed to be overlapped with the body 2A in the left or right side edge portion of the body 2A and is pulled from that position.

According to any of the above embodiments, the water-blocking plate 2 is composed of one plate member. Alternatively, however, the water-blocking plate 2 may be composed of plate members connected to each other.

Figure 18A:
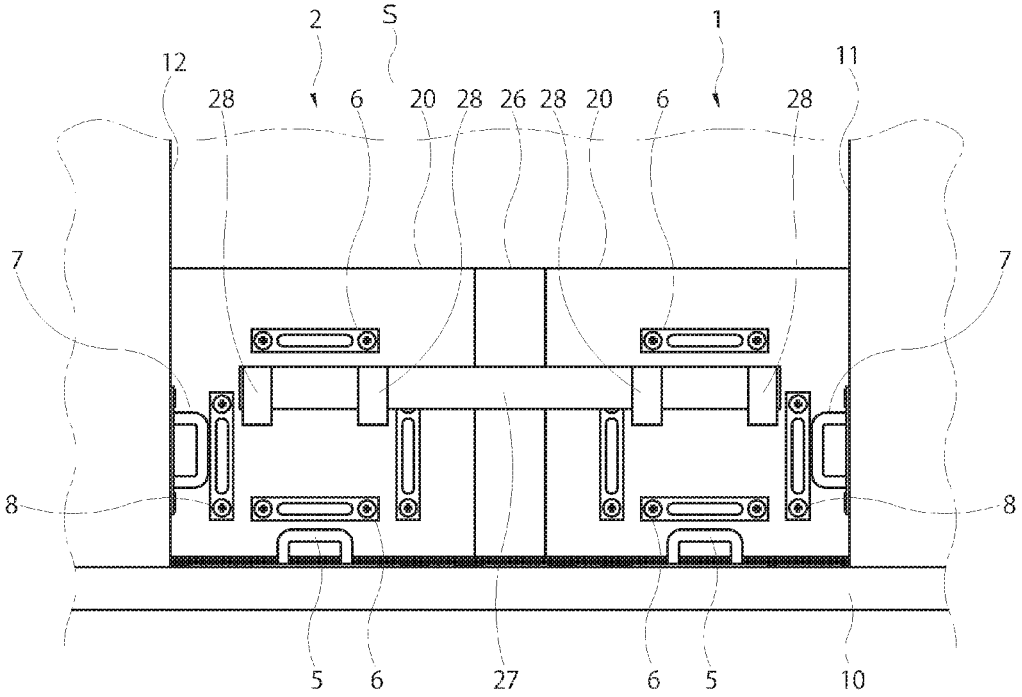
FIGS. 18A and 18B show a modification of the water-blocking plate. 18A is a front elevation view. 18B is an enlarged plan view of the main portion.
Figure 18B:
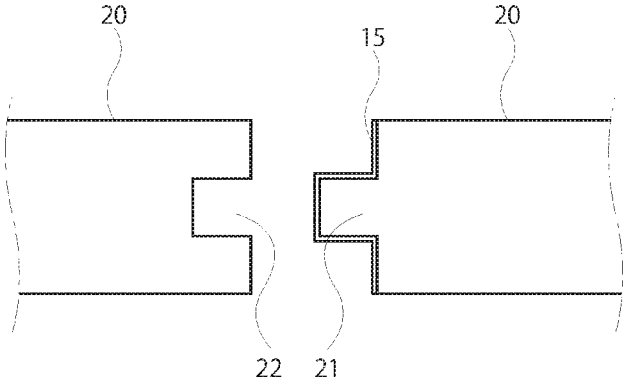

For example, when the water-blocking plate 2 is composed of two plate members 20, for example, as shown in FIGS. 18A and 18B, a tongue 21 is formed on an end face of one of the two adjacent plate members 20, and a groove engaging with the tongue is formed on an end face of the other adjacent plate member. The tongue 21 is engaged with the groove 22 to directly connect the end faces of the two plate members 20. At this time, water intrusion from the interface between the adjacent plate members 20 can be prevented by applying a caulking material 15 to the end face of one of the plate members 20 and to the surface of the tongue 21 and also applying a water-blocking tape 26, such as a gummed cloth tape, to the interface between the adjacent plate members 20. The water-blocking plate 2 may be composed of two or more plate members 20. The plate members 20 can be connected to each other not only in the left-right direction but also in the up-down direction.

Figure 19A:
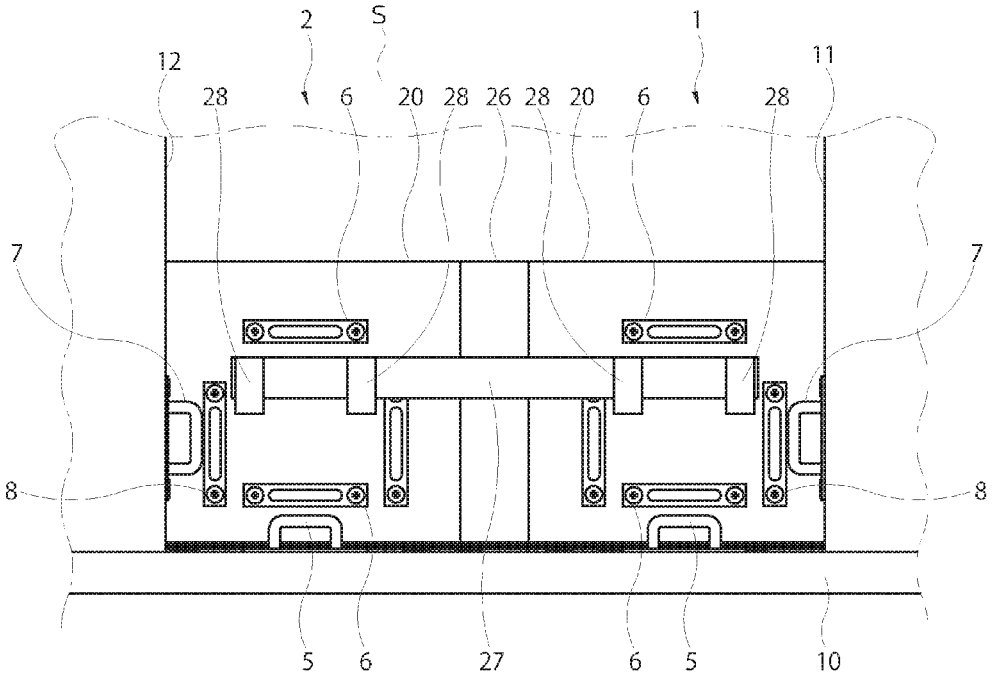
FIGS. 19A and 19B shows another modification of the water-blocking plate. 19A is a front elevation view. 19B is an enlarged plan view of the main portion.
Figure 19B:
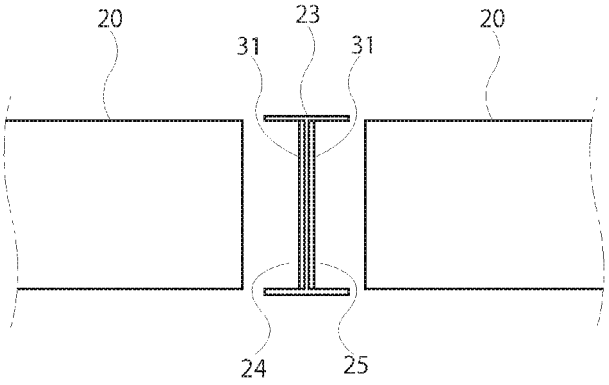

For example, as shown in FIGS. 19A and 19B, a plurality (two pieces in the Fig.) of plate members 20 may be connected via a frame material 23. The frame material 23 is made of, for example, a metal such as H steel, and is provided with a first groove 24 into which one side edge of one of the adjacent plate members 20 is fitted, and a second groove 25 into which one side edge of another of the adjacent plate members 20 is fitted. The plate members 20 are fitted into the first groove 24 and the second groove 25 via an adhesive layer 31, such as a pressure-sensitive adhesive, an adhesive or a double-sided tape. At this time, water intrusion from the interface between the adjacent plate members 20 can be prevented by applying a water-blocking tape, such as a gummed cloth tape, to the interface between the adjacent plate members 20. The water-blocking plate 2 may be composed of two or more plate members 20. The plate members 20 can be connected to each other not only in the left-right direction but also in the up-down direction.

When the water-blocking plate 2 is composed of plate members 20, a reinforcing member 27 is preferably mounted astride adjacent plate members 20 to thereby increase the stiffness of the water-blocking plate 2. The reinforcing member 27 may be, for example, a bar made of wood or metal. The cross-sectional shape of the reinforcing member 27 may be any of various shapes, such as rectangular or circular. When each plate member 20 is provided with a receiver having a square U-shaped or L-shaped cross section for supporting the reinforcing member 27, and the reinforcing member 27 is disposed along the plate members 20 forming the water-blocking plate 2, the adjacent plate members 20 are prevented from being easily bent, thus enhancing the durability.

DESCRIPTION OF THE REFERENCE NUMERALS

1: Water-blocking device
2: Water-blocking plate
3: First band
4: Second band
5: First band passer
6: Second band passer
7: Third band passer
8: Fourth band passer
13: Buffer
14: Packing material
15: Caulking material
20: Plate
21: Tongue
22 Groove
23 Frame material
24 First groove
25 Second groove
26 Water-blocking tape
27 Reinforcing member
28 Receiver
29 Projection

The invention claimed is:

1. A water-blocking device for installation on a floor surface to block water flowing from an open space of a structure, the device comprising:

a water-blocking plate, a first band for fixing the water-blocking plate to the floor surface, and at least one first band passer mounted near an installation location of the water-blocking plate on the floor surface, wherein the water-blocking plate comprises at least one second band passer, the at least one second band passer being a pair of upper and lower band passers mounted on the water-blocking plate;

the first band is wound through the at least one first band passer and the at least one second band passer in such a manner that a part of the first band extends substantially vertically between the upper and lower band passers and a pressing force toward the floor surface is exerted onto the water-blocking plate.

2. The water-blocking device according to claim 1, wherein the at least one first band passer is mounted on the floor surface at the structure side as viewed from the installation location of the water-blocking plate, and the water-blocking plate is supported by the columns or walls at the side opposite to the structure.

3. The water-blocking device according to claim 1, wherein the water-blocking plate comprises a projection projecting from the plate surface below the at least one second band passer, and the first band is wound through the at least one first band passer and the at least one second band passer in such a manner that the first band rides over the projection and extends substantially vertically between the projection and the at least one first band passer.

4. The water-blocking device according to claim 1, wherein a buffer, a first caulking material, a packing material, and a second caulking material are disposed in this order between the floor surface and the water-blocking plate.

5. The water-blocking device according to claim 1, wherein the water-blocking plate comprises plate members connected to each other, an end face of one of the adjacent plate members is provided with a tongue, an end face of another of the adjacent plate members is provided with a groove to be engaged with the tongue, and a water-blocking tape is applied to an interface between the adjacent plate members.

6. The water-blocking device according to claim 5, wherein the water-blocking plate further comprises a reinforcing member disposed astride the adjacent plate members, and each of the adjacent plate members comprises a receiver for supporting the reinforcing member.

7. The water-blocking device according to claim 1, wherein the water-blocking plate comprises plate members connected to each other via a frame material, the frame material comprises a first groove into which one side edge of one of the adjacent plate members is fitted via an adhesive layer, and a second groove into which one side edge of another of the adjacent plate members is fitted via an adhesive layer, and a water-blocking tape is applied to an interface between the adjacent plate members.

8. The water-blocking device according to claim 7, wherein the water-blocking plate further comprises a reinforcing member disposed astride the adjacent plate members, and each of the adjacent plate members comprises a receiver for supporting the reinforcing member.

9. A water-blocking device for installing on a floor surface to block water flowing from an open space of a structure, the device comprising:

a water-blocking plate that includes at least one second band passer, at least one first band passer mounted near an installation location of the water-blocking plate on the floor surface, a first band for fixing the water-blocking plate to the floor surface, the first band being wound through the at least one first band passer and the at least one second band passer in such a manner that a pressing force toward the floor surface is exerted onto the water-blocking plate, third band passers mounted on right and left columns or walls defining the width of the open space, and second bands for fixing the water-blocking plate to the columns or walls, wherein the water-blocking plate comprises a pair of left and right fourth band passers, and the second bands are wound through the third band passers and the fourth band passers in such a manner that pressing forces toward the columns or walls are exerted onto the water-blocking plate.

10. The water-blocking device according to claim 9, wherein the at least one second band passer is a pair of upper and lower band passers mounted on the water-blocking plate, and the first band is wound through the at least one first band passer and the at least one second band passer in such a manner that a part of the first band extends substantially vertically between the upper and lower band passers.

11. The water-blocking device according to claim 10, wherein the at least one first band passer is mounted on the floor surface at the structure side as viewed from the installation location of the water-blocking plate, and the water-blocking plate is supported by the columns or walls at the side opposite to the structure.

12. The water-blocking device according to claim 9, wherein the water-blocking plate comprises a projection projecting from the plate surface below the at least one second band passer, and the first band is wound through the at least one first band passer and the at least one second band passer in such a manner that the first band rides over the projection and extends substantially vertically between the projection and the at least one first band passer.

* * * * *